United States Patent [19]

Pinkerton et al.

[11] Patent Number: 5,015,157

[45] Date of Patent: May 14, 1991

[54] PUMP WITH MULTI-PORT DISCHARGE

[76] Inventors: Dennis Pinkerton, 260 Sherbrook Rd., Lindenhurst, N.Y. 11757; Robert W. Jaekel, 1233 Yorkshire La., Barrington, Ill. 60010; Guillermo P. Pardinas, 11091 SW. 61 Ter., Miami, Fla. 33173

[21] Appl. No.: 463,260

[22] Filed: Jan. 10, 1990

[51] Int. Cl.[5] ..... F04B 7/06

[52] U.S. Cl. ..... 417/500; 417/492; 417/493

[58] Field of Search ..... 417/492, 493, 500

[56] References Cited

U.S. PATENT DOCUMENTS

| | | | |
|---|---|---|---|
| 3,083,895 | 4/1963 | Welles, Jr. | 417/500 |
| 3,168,872 | 2/1965 | Pinkerton | 417/500 |
| 4,479,759 | 10/1984 | Zeitz | 417/500 |

*Primary Examiner*—Leonard E. Smith
*Assistant Examiner*—M. Kocharov
*Attorney, Agent, or Firm*—Hoffmann & Baron

[57] ABSTRACT

A valveless, positive displacement metering pump is provided which is capable of either mixing two or more fluids or dividing a fluid from an inflow line into two or more outflow lines. The pump includes a housing which contains a cylindrical working chamber at different radial positions. Three or more passages extend through the housing and communicate with the working chamber. A piston is positioned within the working chamber. The piston includes a duct defined by its outer surface which communicates with one of the passages, depending upon its rotational position. The piston is rotated as it is driven back and forth within the cylinder, thereby causing the duct to sequentially communicate with the passages and the piston to sequentially close the passages. Depending upon the axial direction of movement of the piston, fluid is either pumped into or out of the working chamber as the duct rotates into communication with one of the passages.

17 Claims, 4 Drawing Sheets

PUMP WITH MULTI-PORT DISCHARGE

BACKGROUND OF THE INVENTION

1. Field of the Invention

The field of the invention relates to metering pumps for pumping relatively precise volumes of fluid.

2. Brief Description of the Prior Art

Valveless, positive displacement metering pumps have been successfully employed in many applications where safe and accurate handling of fluids is required. The valveless pumping function is accomplished by the synchronous rotation and reciprocation of a piston in a precisely mated cylinder bore. One pressure and one suction stroke are completed per cycle. A duct (flat portion) on the piston connects a pair of cylinder ports alternately with the pumping chamber, i.e. one port on the pressure portion of the pumping cycle and the other on the suction cycle. The mechanically precise, free of random closure variation valving is performed by the piston duct motion. A pump head module containing the piston and cylinder is mounted in a manner that permits it to be swiveled angularly with respect to the rotating drive member. The degree of angle controls stroke length and in turn flow rate. The direction of the angle controls flow direction. This type of pump has been found to perform accurate transfers of both gaseous and liquid fluids.

In some applications, it is necessary to provide two or more discharges of a fluid in selected proportions. This has typically been accomplished by using two separate pumps, or one pump and a multi-position flow diverter such as a solenoid valve.

A valveless positive displacement pump including multiple ports is disclosed in U.S. Pat. No. 4,008,003. The pump includes a cylinder divided into a pair of working chambers, each of the chambers communicating with two ports. In essence, the disclosed pump operates as two separate pumps.

SUMMARY OF THE INVENTION

It is an object of the invention to provide a valveless, positive displacement metering pump including means for dividing the intake and/or discharge stroke into two or more parts.

It is another object of the invention to provide a valveless, positive displacement metering pump capable of dispensing fluids at precise flow rates.

In accordance with these and other objects of the invention, a valveless, positive displacement metering pump is provided which includes a housing; a working chamber within the housing; first, second and third passages extending through the housing and adjoining the working chamber at first, second and third radial positions, respectively, a piston within the working chamber, the piston including a duct defined by its outer surface; means for oscillating the piston back and forth within the working chamber; and means for rotating the piston, the piston being positioned such that the duct is in sequential fluid communication with the first, second and third passages, respectively, as the piston is oscillated and rotated within the working chamber. The piston is also driven such that it is moving in a first axial direction when the duct is in fluid communication with one of the passages and the opposite axial direction when in fluid communication with each of the other two passages.

DETAILED DESCRIPTION OF THE INVENTION

A valveless, positive displacement metering pump 10 is provided which includes at least three ports, two of which are used at any one time either as inlet or outlet ports while the other is used in an opposite manner.

Figure 1:
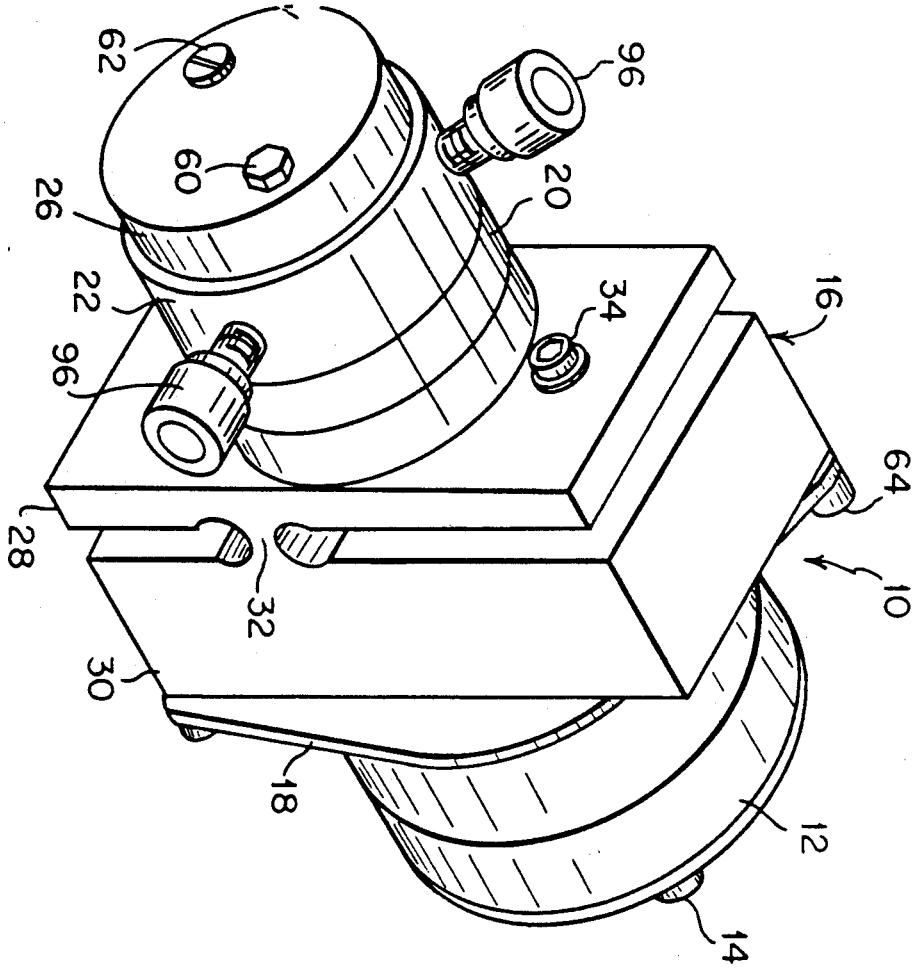
FIG. 1 is a front perspective view of a valveless, positive displacement metering pump according to the invention.
Figure 2:
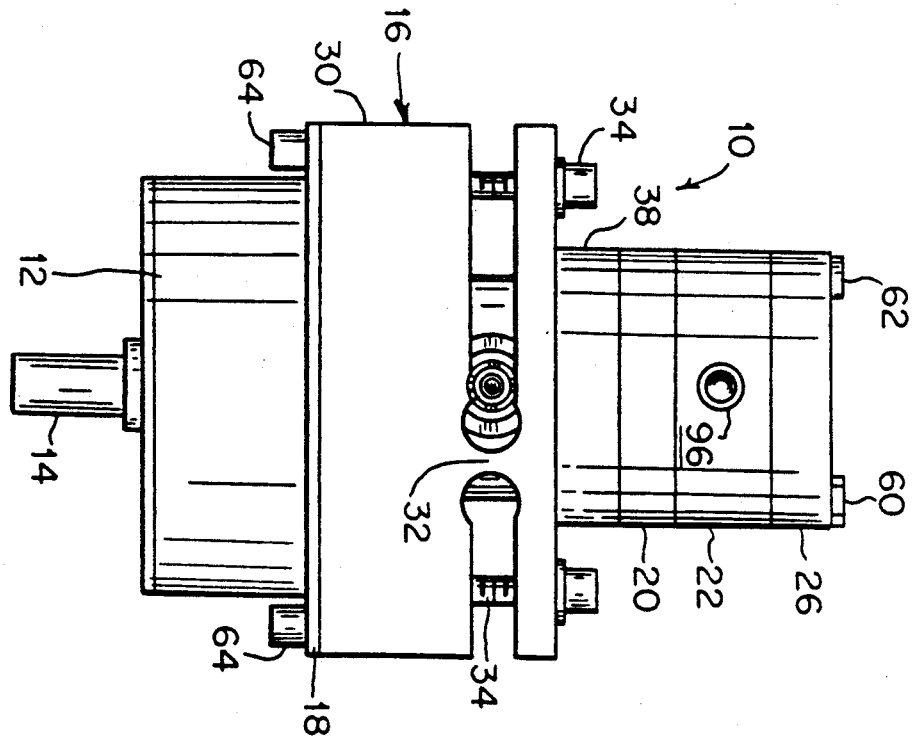
FIG. 2 is a top plan view thereof.
Figure 3:
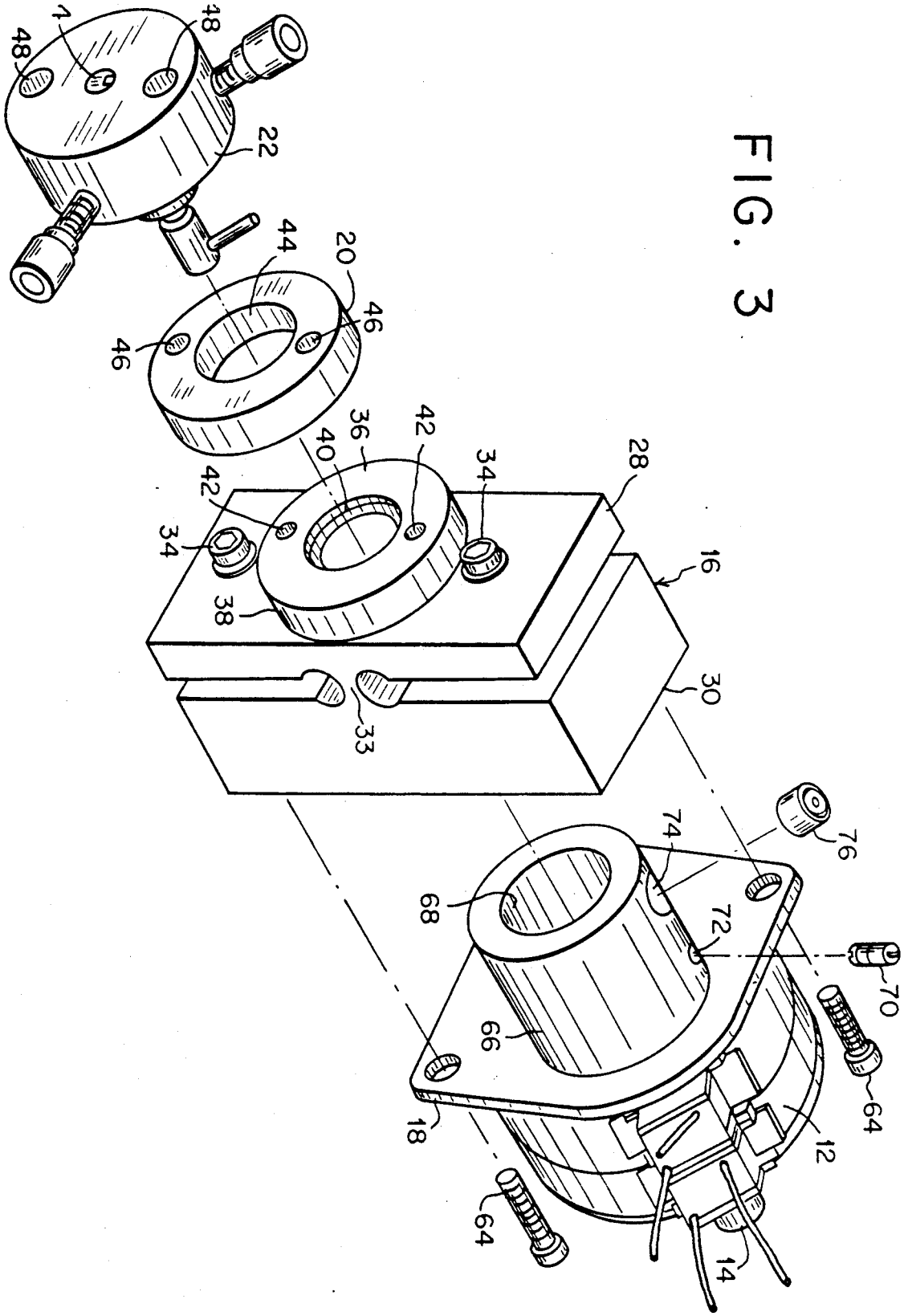
FIG. 3 is an exploded, front perspective view thereof.

Referring to FIGS. 1–3, the pump 10 includes a motor 12 including a drive shaft 14, an integral, hinged block 16, a flat, metal plate 18 secured to the motor housing and the block 16, a cylindrical spacer 20 adjoining the block 16, a cylindrical housing 22 which includes a cylindrical working chamber 24, and a cylindrical closure 26.

The hinged block 16 is made from any suitable ductile material, such as DELRIN, an acetyl copolymer. The block includes a front portion 28 and a rear portion 30 connected by an integral hinge 32. The rear portion 30 includes a pair of threaded bores, while the front portion 28 includes a pair of unthreaded holes aligned with the threaded bores. First and second screws 34 extend through the respective holes and bores. By turning the screws, the angular orientation of the front portion 28 of the block may be changed with respect to the rear portion 30 as it moves about the integral hinge 32.

The block 16 includes a large, cylindrical bore which extends completely through the rear portion 30 and terminates at a front wall 36 of a cylindrical projection 38 extending from the front portion 28. A smaller bore 40 extends through this wall 36. Two small, threaded bores 42 extend at least partially through the projection 38.

The spacer 20 includes an axial bore 44 having about the same diameter as the above-mentioned bore 40, and a pair of unthreaded bores 46 extending therethrough. The axial bore 44 is aligned with the bore 40 through the front wall 36 of the projection 38 while the two smaller bores 46 are aligned, respectively, with the two small, threaded bores 42 within the projection 38.

Figure 4:
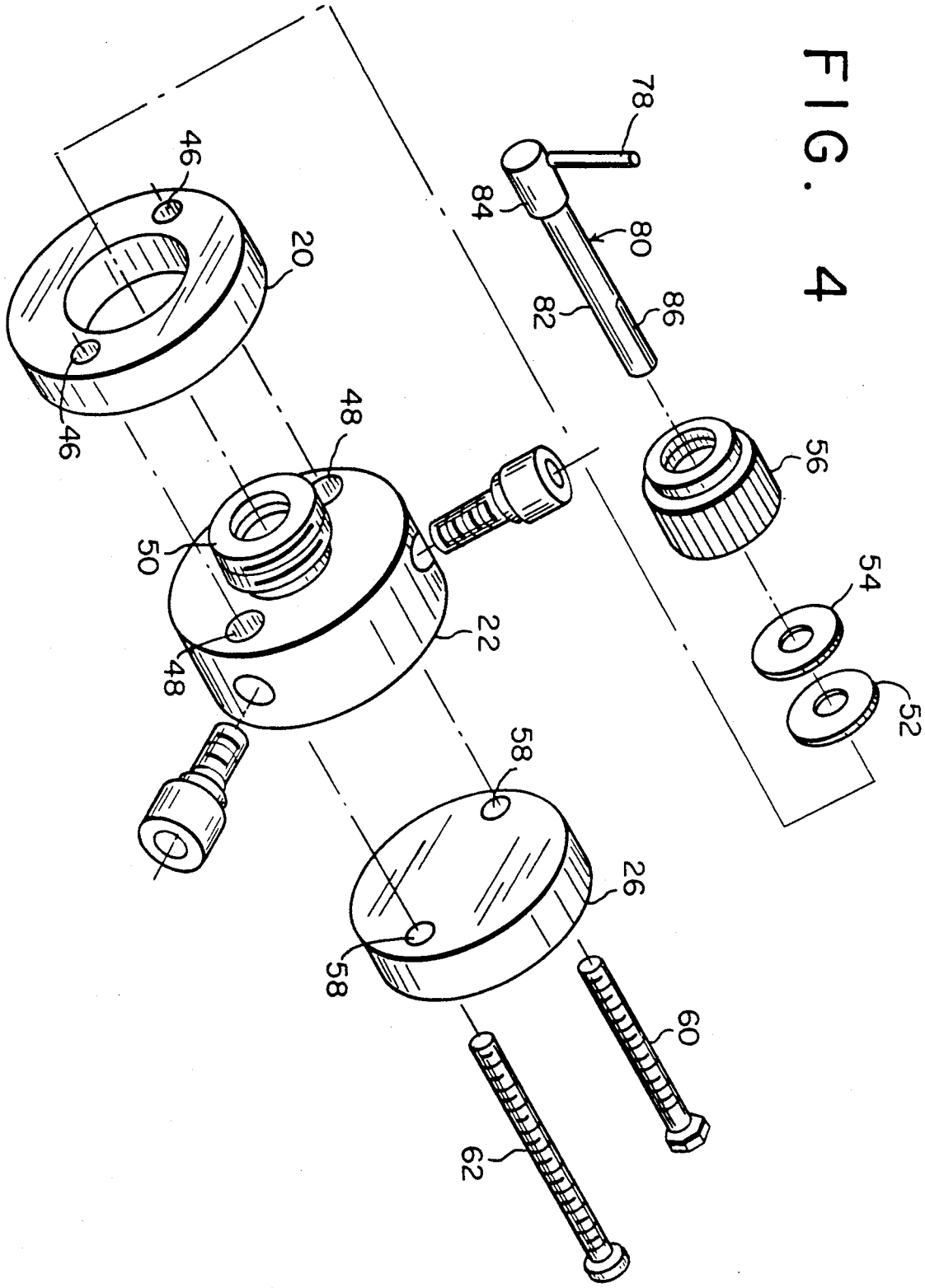
FIG. 4 is an exploded, rear perspective view of several elements of said pump.
Figure 5:
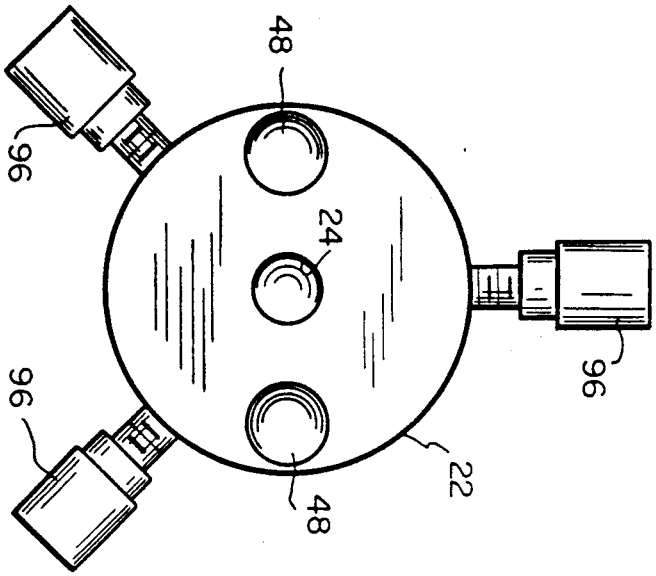
FIG. 5 is a front perspective view of a housing for a pump working chamber.

The housing 22 for the working chamber 24 includes a pair of bores 48 aligned with the bores 46 extending through the spacer. It is preferably made from a ceramic material such as carbon fiber reinforced polyphenylinesulfide, which is sold, for example, under the trade name RYTON. A threaded, cylindrical projection 50, formed integrally with the housing 22, extends rearwardly therefrom. A pair of washers 52,54, as shown in FIG. 4, adjoin the flat, rear face of the projection 50, and are maintained in place by a gland nut 56.

The closure 26 includes a pair of bores 58 extending therethrough. These bores 58 are aligned with the bores 48 extending through the housing 22 of the working chamber 24. The closure includes a flat rear surface which adjoins the flat front surface of the housing 22. It accordingly seals one end of the working chamber 24. As an alternative, the housing and closure could be constructed as one piece, thereby obviating the need for a separate closure. A pair of screws 60,62 extend through the pairs of bores 58,48,46, respectively, and are threadably secured to the block 16 by means of the threaded bores 42. The closure 26, housing 22, spacer 20 and block 16 are secured, respectively, to each other by this pair of screws 60,62. Each of these elements is shown as having substantially the same outside diameters.

As discussed above, the flat plate 18 is secured to the motor housing. A pair of screws 64 secure the plate 18 to the block 16. As shown in FIG. 3, the front portion of the motor drive shaft 14 is secured to a cylindrical enclosure 66. The enclosure includes a cylindrical chamber 68 having an open front end. The rear end of the chamber is closed by a wall (not shown) through which the front portion of the drive shaft 14 extends. A lock screw 70 extends through a threaded bore 72 which extends through this wall, and bears against the drive shaft 14. The enclosure 66 accordingly rotates with the drive shaft when the motor 12 is actuated.

Figure 8:
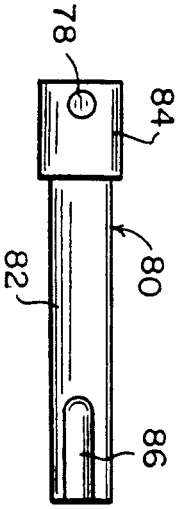
FIG. 8 is a side elevation view of a piston.
Figure 9:
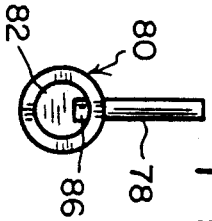
FIG. 9 is a front elevation view thereof.

A second, relatively larger bore 74 extends through the cylindrical enclosure 66 and communicates with the chamber 68 therein. A ball and socket fitting 76 is positioned within the bore 74. The ball member of this fitting includes a passage extending therethrough for receiving a connecting rod 78 of a piston assembly 80. The piston assembly, which is best shown in FIGS. 4,8 and 9, includes a cylindrical piston member 82, a cap 84 secured to the rear end of the piston member, the connecting rod 78 extending through the cap and piston member. The front end of the piston member 82 includes a longitudinal duct extending from the end surface thereof to a selected point behind this end surface. The duct is preferably in the form of a channel such as a relieved portion 86 including a flat bottom wall and a pair of side walls extending perpendicularly therefrom. A v-shaped channel would provide generally equivalent operating results, while a duct in the form of a flat might not allow adequate fluid flow in some instances.

Referring now to FIGS. 4–7, the housing 22 for the working chamber 24 is constructed so that the piston member 82 can rotate and reciprocate freely within the working chamber 24. The front end of the piston member is accordingly chamfered to facilitate such reciprocation. The clearance between the piston member and wall of the working chamber may be about one ten thousandth of an inch. The maximum length of the stroke of the piston member is such that the relieved portion 86 is always entirely within the working chamber 24, and is substantially always in fluid communication with at least one of the three passages 88,90 communicating with the working chamber.

In the embodiment of the invention depicted in the drawings, three passages adjoin the working chamber. The diameters of the passages, axial, position of the passages, and the width of the relieved portion 86 are all important in insuring that the proper flow rates into and out of the passages will be obtained.

Figure 6:
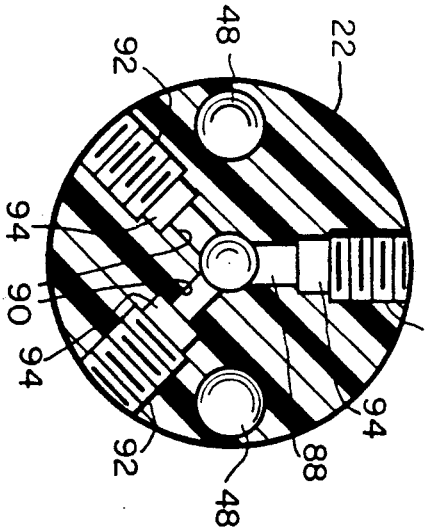
FIG. 6 is a sectional, front elevation view thereof.
Figure 7:
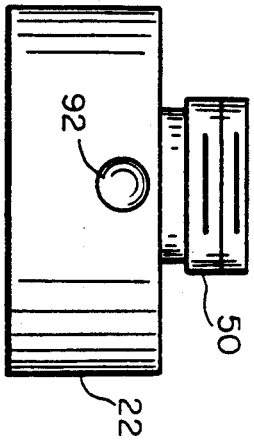
FIG. 7 is a top plan view thereof.

As best shown in FIG. 6, one relatively large diameter passage 88 extends along a reference axis which is substantially vertical. Two smaller diameter passages 90 each extend at a forty-five degree angle with respect to the reference axis, and are therefore ninety degrees apart. The diameter of the relatively large passage 88 is twice the diameter of each smaller passage 90. The diameters of the passages would, of course, be adjusted if additional passages were employed.

In a particular embodiment of the invention, discussed here solely for explanatory purposes, a piston member 82 having a quarter inch diameter is employed. The relieved portion 86 within the piston member has a length of about three eights of an inch. The depth and width of the relieved portion are about 0.093 inches. The channel accordingly traverses an axial distance of about forty-five degrees. The relatively large passage 88 has a diameter of about 0.177 inches while each of the smaller passages 90 in fluid communication with the working chamber 24 have diameters of about 0.089 inches. The axes of the three passages are substantially coplanar so that each will communicate with the relieved portion 86 for a selected length of time as the piston assembly is rotated.

Each passage communicates with a threaded bore 92 which extends between the outer surface of the housing 22 and an angular seating surface 94. A tube (not shown) having a conical fitting (not shown) secured to its end may be inserted with one of the threaded bores until the conical fitting contacts the seating surface 94. The conical fitting is maintained in place by a lock screw 96 which is engaged by the threaded bore. The lock screw presses the conical fitting against the seating surface 94 to provide a fluid-tight seal.

In operation, the stroke of the piston assembly is adjusted by turning screws 34 to a position where the front portion 28 of the block 16 is at a selected angular orientation with respect to the second portion 30 thereof. The piston assembly will be caused to reciprocate upon rotation of the motor shaft 14 unless the front and rear portions of the block 16 are parallel to each other. When in the pumping mode, the rotation of the motor shaft causes rotation of the cylinder 66 secured thereto. The piston assembly 80, being connected to the cylinder 66 by the fitting 76 and connecting rod 78, rotates about its axis at the same time it is caused to reciprocate. The angular orientation of the front portion 28 of the block, and therefore the working chamber 24, with respect to the rear portion 30 of the block, causes the rotation of the fitting 76, and therefore the piston assembly to be eccentric with respect to the working chamber. This causes the combined rotational and reciprocal motion of the piston member 82 within the working chamber 24.

The housing 22 is oriented with respect to the block such that the piston member 82 will be moving in a first axial direction as the relieved portion 86 communicates with the largest of the three passages and in an opposite direction as it moves into communication with the smaller passages 90. For example, if the relatively large passage 88 were to be used as an inflow passage, and the smaller passages were to be used for fluid outflow, the piston assembly would move inwardly as the relieved portion communicates with the larger passage. Suction would be created, and fluid would be drawn into the channel and working chamber. The smaller passages 90 would be sealed by the cylindrical outer surface of the piston member 82 during this phase. As the piston assembly would continue to rotate, it would eventually start moving in the opposite axial direction, i.e. towards the closure 26. The relieved portion would communicate with one of the smaller passages, and then the other, during this pumping phase, thereby moving fluid from the working chamber, through the relieved portion, and into the respective passages. The larger passage 88 would be closed at this time. To reverse the action of the pump, the front portion 28 of the block 16 would simply have to be pivoted about the hinge 32 to an opposite angular orientation.

In order to avoid undue strain upon the pump, the length and width of the relieved portion 86, and the diameters and positions of the three passages 88,90 are constructed such that the relieved portion is substantially always in fluid communication with one of the three passages regardless of the axial or rotational position of the piston assembly 80. The stroke of the piston assembly should be less than the length of the relieved portion.

While the pump shown in the figures includes only three passages which communicate with the relieved portion and working chamber, it will be appreciated that additional passages may be provided at different radial positions to provide additional inflow or outflow capability. The diameters of the respective passages may also be modified if unequal flows are desired.

In accordance with the pump as illustrated, the relatively large passage 88 is in fluid communication with the relieved portion over about one hundred eighty degrees of rotation of the piston assembly 80. The second and third passages, which have the same diameter, each communicate with the relieved portion over about ninety degrees of rotation apiece. The piston member 82 moves in one axial direction as the relieved portion communicates with the first passage 88. It moves in the opposite axial direction when communicating with the other two passages 90. Both the passages and the relieved portion form relatively sharp corners with respect to the working chamber to insure the precise control of fluid flow within the pump.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

We claim:

1. A valveless, positive displacement metering pump comprising:

a housing;

a cylindrical working chamber positioned within said housing;

a first passage in fluid communication with said working chamber and extending through said housing;

a second passage in fluid communication with said working chamber and extending through said housing;

a third passage in fluid communication with said working chamber and extending through said housing;

said first, second and third passages adjoining said working chamber at first, second and third radial positions, respectively, with respect to the longitudinal axis of said working chamber;

a piston positioned within said working chamber, said piston including a substantially cylindrical outer surface and a relieved portion defined by said outer surface;

means for reciprocating said piston back and forth within said working chamber and means for rotating said piston as it is reciprocated such that said relieved portion communicates sequentially with said second and third passage while said piston is moving in a first axial direction and communicates with said first passage while said piston is moving in a second axial direction opposite to said first axial direction.

2. A pump as defined in claim 1 wherein said relieved portion is a channel defined by said outer surface of said piston, said channel including a pair of opposing side walls.

3. A pump as defined in claim 2 wherein said first, second and third passages adjoin said working chamber in substantially the same plane.

4. A pump as defined in claim 1 wherein said first, second and third passages adjoin said working chamber in substantially the same plane.

5. A pump as defined in claim 1 wherein said first, second and third passages are substantially coplanar throughout their length.

6. A pump as defined in claim 1 including means for adjusting the stroke of said piston.

7. A pump as defined in claim 1 wherein said relieved portion and each of said first, second and third passages adjoin said working chamber such that said relieved portion is in fluid communication with at least one of said passages at substantially all rotational positions of said piston.

8. A pump as defined in claim 1 wherein said first passage communicates with said relieved portion over a larger range of rotation of said piston than either of said second or third passages.

9. A pump as defined in claim 8 wherein said first passage communicates with said relieved portion over about one hundred eighty degrees of rotation of said piston.

10. A pump as defined in claim 9 wherein said second and third passages are in sequential fluid communication with said relieved portion over about one hundred eighty degrees of rotation of said piston.

11. A pump as defined in claim 1 wherein said first, second and third passages are all substantially cylindrical where they adjoin said working chamber.

12. A pump as defined in claim 8 wherein said relieved portion is a channel defined within said outer surface of said piston, said channel including a pair of opposing side walls.

13. A pump as defined in claim 12 wherein said channel and each of said first, second and third passages are constructed and positioned such that said channel is in fluid communication with at least one of said passages at substantially all rotational positions of said piston.

14. A valveless, positive displacement metering pump comprising:

a housing:

a cylindrical working chamber positioned within said housing;

at least three passages extending through said housing and communicating with said working chamber;

a substantially cylindrical piston positioned within said working chamber, said piston including an outer surface and a relieved portion defined by said outer surface of said piston;

means for reciprocating said piston within said working chamber;

means for rotating said piston as it is reciprocated such that said relieved portion communicates sequentially with at least two of said passages while moving in a first axial direction during a single stroke of said piston;

said piston and said passage being positioned such that said duct is in sequential fluid communication with said respective passages as said piston is reciprocated and rotated within said working chamber, said relieved portion being in fluid communication with only one of said respective passages in substantially all rotational positions of said piston, and said piston closing all but one of said respective passages in substantially all rotational positions of said piston.

15. A pump as defined in claim 14 wherein at least one of said passages communicates with said relieved portion over a larger range of rotation of said piston than at least one other of said passages.

16. A pump as defined in claim 14 wherein said relieved portion is an elongated channel defined by said outer surface of said piston, said channel including a pair of opposing side walls.

17. A pump as described in claim 1 wherein said passages and said relieved portion are arranged such that said relieved portion communicates with only one of said passages at any one time.

* * * * *

UNITED STATES PATENT AND TRADEMARK OFFICE

CERTIFICATE OF CORRECTION

PATENT NO. : 5,015,157

DATED : May 14, 1991

INVENTOR(S) : Pinkerton et al.

It is certified that error appears in the above-identified patent and that said Letters Patent is hereby corrected as shown below:

Column 3, line 59 now reads "passages, axial,",
should read --axial passages--;

Claim 14, Column 7, line 1, now reads "passage",
should read --passages--;

Claim 14, Column 7, line 2, now reads "duct",
should read --relieved portion--;

Signed and Sealed this

Seventeenth Day of November, 1992

*Attest:*

DOUGLAS B. COMER

*Attesting Officer*

*Acting Commissioner of Patents and Trademarks*